US007492672B2

(12) United States Patent
Cuisinier

(10) Patent No.: US 7,492,672 B2
(45) Date of Patent: Feb. 17, 2009

(54) ALARM PROCESS AND DEVICE

(76) Inventor: Jarret Peter Cuisinier, 648 Guerrero St., San Francisco, CA (US) 94110

( * ) Notice: Subject to any disclaimer, the term of this patent is extended or adjusted under 35 U.S.C. 154(b) by 0 days.

(21) Appl. No.: 11/655,598

(22) Filed: Jan. 19, 2007

(65) Prior Publication Data

US 2007/0189124 A1 Aug. 16, 2007

Related U.S. Application Data

(60) Provisional application No. 60/760,137, filed on Jan. 19, 2006.

(51) Int. Cl.
*G04B 23/00* (2006.01)

(52) U.S. Cl. ..... 368/262; 368/73

(58) Field of Classification Search ..... 368/71, 368/72, 73, 261, 262, 263
See application file for complete search history.

(56) References Cited

U.S. PATENT DOCUMENTS

| | | | | | |
|---|---|---|---|---|---|
| 4,240,154 | A * | 12/1980 | Sekine | ..... | 368/72 |
| 5,212,672 | A * | 5/1993 | Loisch et al. | ..... | 368/79 |
| 5,928,133 | A * | 7/1999 | Halyak | ..... | 600/26 |
| 6,236,622 | B1 * | 5/2001 | Blackman | ..... | 368/10 |
| 2003/0095476 | A1 * | 5/2003 | Mollicone et al. | ..... | 368/250 |

* cited by examiner

*Primary Examiner*—Renee Luebke
*Assistant Examiner*—Jason Collins

(57) ABSTRACT

An alarm process and device capable of waking a user more comfortably by means of a rousing instrument. For example, an alarm device may rouse a user a predetermined time before a desired waking time, resetting the user's sleep cycle before waking. A user may then be woken more comfortably at a desired waking time and during a preferable stage of the sleep cycle.

17 Claims, 2 Drawing Sheets

ALARM PROCESS AND DEVICE

CROSS-REFERENCE TO RELATED APPLICATIONS

This application claims priority to U.S. Provisional Patent Application Ser. No. 60/760,137 entitled "Alarm Process and Device" and filed on Jan. 19, 2006 which is incorporated herein by reference.

FIELD OF INVENTION

This invention relates to devices for waking people from sleep, and more particularly, to devices such as alarms.

BACKGROUND OF THE INVENTION

The use of alarms to wake people has long been known to the prior art. These alarms come in a variety of forms but often comprise a time keeping device with an integrated sound device. At a predetermined time, the time device is configured to trigger the sound device which provides sufficient sound for waking a person from sleep. Along these lines, a number of variations have been developed to give users additional options. First, these devices have been evolved and integrated into numerous forms. Often, alarm devices can be found in bedside machines, radios, stereos, wrist watches, cell phones, computers, PDAs, mp3 players, computer programs, and various other hardware and software embodiments. Second, the option of "snoozing" is often incorporated into alarm devices. Via snoozing a user may delay waking by hitting a button to stop the sound device and trigger it for a later time (typically 9 minutes later). Third, some alarm devices with incorporated radios or stereos have a "sleep" option that lets a user fall to sleep for a set amount of time to music or sounds. Additionally, a user may often set such devices to wake a user to music or sounds as well.

It is also known in the prior art that human sleep typically follows an iterative cycle usually lasting 70-90 minutes per iteration. Additionally, it is known that if a person is woken at different stages during this sleep cycle they will have different levels of comfort and restored physical rehabilitation. Typically, a person wakes most easily, comfortably, and refreshed at the end of a full 70-90 minute sleep cycle. Furthermore, it is known in the prior art that body variables like a person's body temperature, movement, breathing rate, eye movement, and heart rate vary during these sleeping cycles and that this information can be used to determine what stage of the sleep cycle a person is in.

Accordingly, an alarm device that wakes a person during the best time in his or her sleep cycle is desirable. Additionally, an alarm clock that uses body variables to determine when is best to wake a person is further desirable.

SUMMARY OF THE INVENTION

The present invention provides an alarm process and device that wakes a user opportunely during the user's sleep cycle. In accordance with an exemplary embodiment of the present invention, an alarm device is configured to comprise a time device and a rousing instrument. By virtue of these, a user can be woken by the alarm device. First, the alarm device may passively rouse a user a predetermined time before the user wishes to be woken. After the passive rousing, the user will begin a new sleep cycle that will last until the user is woken at the desired waking time when the predetermined time elapses. Via this process, the alarm device may wake the user at various stages in the sleep cycle. For example, the predetermined time may be harmonized with the expected time until a preferable stage of the sleep cycle (e.g. the end of the sleep cycle) and via this configuration the alarm device may wake the user at the desired waking time during a preferable stage of the sleep cycle, allowing the user to more easily and comfortably wake.

BRIEF DESCRIPTION OF THE DRAWINGS

Additional aspects of the present invention will become evident upon reviewing the non-limiting embodiments described in the specification taken in conjunction with the accompanying figures, wherein like numerals designate like elements, and.

DETAILED DESCRIPTION

The following descriptions are of preferred exemplary embodiments only, and are not intended to limit the scope, applicability, or configuration of the invention in any way. Rather the following description provides a convenient illustration for implementing a preferred embodiment of the invention. Various changes may be made in the function and arrangement of elements described in the preferred embodiments without departing from the spirit and scope of the invention as set forth herein.

Generally, in accordance with an exemplary embodiment of the present invention, an alarm device is provided comprising a rousing instrument. The alarm device is suitably configured to wake a user more comfortably and refreshed by means of the rousing instrument. For example, the alarm device may rouse a user a predetermined time before a desired waking time. This rousing may reset the user's sleep cycle before waking and, via the predetermined time, may guide the user's sleep cycle to be in a preferable stage of the sleep cycle (e.g. the end of the sleep cycle) at the desired waking time. Thus, at the desired waking time and during a preferable stage of the sleep cycle, the user may be woken more comfortably, easily, and refreshed. In this way, a user will feel like they have woken from a good nap on top of a night's sleep.

In accordance with an exemplary embodiment of the present invention, the alarm device may comprise a sensor to detect when is best to wake a user from sleep after rousing. For example, the alarm device may comprise a heartbeat sensor and utilize this information to wake a user at the most comfortable, refreshed, and easy waking time.

Figure 1A:
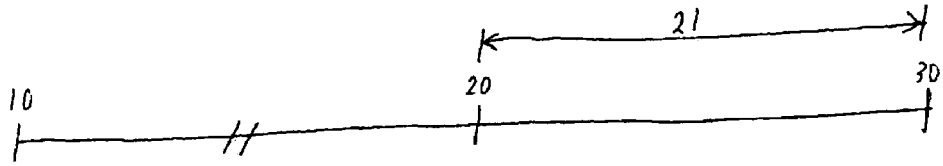
FIG. 1*a* is a diagram of a preferred alarm device process of the present invention comprising a rousing time and a waking time.

Thus, with reference to FIG. 1*a*, in accordance with a preferred embodiment of the present invention, a diagram of an alarm process is shown comprising a sleep start time 10, a rousing time 20, and a waking time 30. In accordance with the present preferred embodiment, rousing time 20 is preferably a predetermined time 21 before waking time 30. Preferably, predetermined time 21 is aligned with a typical full sleep cycle (typically 70-90 minutes) and, in order to account for variances in human sleep cycles, rousing time 20 is preferably set to occur at least 30 minutes before said waking time but not more than 120 minutes before said waking time. However, in accordance with various alternate embodiments, predetermined time 21 may comprise other durations. For example, predetermined time 21 may be settable by a user or may be set to wake a user during other stages of the sleep cycle. Additionally, predetermined time 21 may be tailored based on a specific user's sleep cycle tendencies based on a diagnostic test or input from the user (e.g. morning exhaustion levels).

Figure 1B:
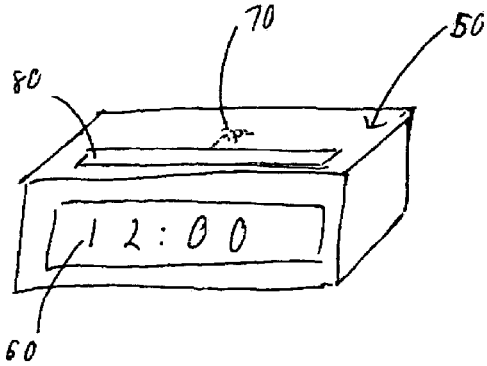
FIG. 1*b* is a perspective view of a preferred embodiment of the present invention in the form of a bedside device and comprising a rousing instrument.

Additionally, and now in reference to FIG. 1*b* and in accordance with a preferred embodiment of the present invention, an alarm device 50 is shown comprising a time instrument 60, a rousing instrument 70, and a deactivator 80. In accordance with the present preferred embodiment, alarm device 50 is preferably configured to be a device for use near a bed. However, in accordance with various alternate configurations, alarm device 50 may be integrated or connectable with other devices known or not yet known, including radios, CD players, mp3 players, watches, PDAs, and the like.

Additionally, rousing instrument 70 may comprise any device that may rouse a person from sleep and preferably activates at rousing time 20 passively. For example, rousing instrument 70 may comprise a sound device emitting a loud beep or set of beeps at rousing time 20 and stopping thereafter without deactivation by the user. Thus, the user will be passively woken from deep sleep. Alternatively, and in accordance with an alternative embodiment of the present invention, rousing instrument 70 may require active deactivation by the user at rousing time 20. For example, rousing instrument 70 may comprise a sound device emitting a set of beeps or noises until a user deactivates rousing instrument 70 via deactivator 80. Deactivator 80 may comprise any device that deactivates rousing instrument 70. In accordance with one aspect of the preferred embodiment, deactivator 80 comprises a button. However, in accordance with various alternate embodiments deactivator 80 may be present as any type of trigger known or not yet known to the prior art. For example, deactivator 80 may comprise a noise-activated device (e.g. device responding to claps), voice-activated device, or the like. Additionally, the use of deactivator 80 with rousing instrument 70 may be settable, allowing the user to select between a passive rousing instrument 70 and an active rousing instrument 70. Furthermore, deactivator 80 may be omitted from various device configurations.

In accordance with one aspect of the preferred embodiment, rousing instrument 70 comprises a sound device. However, in accordance with various alternate embodiments of the present invention, rousing instrument 70 may comprise various alternate configurations known or not yet known to the prior art. For example, rousing instrument 70 may comprise a light device (e.g. camera-like flash), a subsonic emitter, a scent-creating instrument, a tactile device (e.g. fan or vibration), or a combination of various devices. Additionally, such rousing instruments 70 may comprise gradually increasing or decreasing intensities as desirable proximate rousing time 20.

In accordance with one aspect of the preferred embodiment, rousing instrument 70 preferably resets a user's sleeping cycle by bringing the user to a semi-conscious level and thereby initiating a new sleeping cycle for the user. However, in accordance with various alternate embodiments of the present invention, rousing instrument 70 may be configured to rouse a user to another stage in the sleep cycle (known or not yet known) or to wake them fully to a conscious level.

In accordance with another aspect of the present preferred embodiment, rousing instrument 70 is preferably also activated at waking time 30 and, at this time, requires active deactivation by the user via deactivator 80. In this way, rousing instrument 70 is also configured to act as a waking instrument at waking time 30. However, in accordance with various alternate embodiments, a separate waking instrument may be used instead of rousing instrument 70 for waking the user at waking time 30. In such cases, this supplementary waking instrument may comprise various configurations known and not yet known to the prior art for waking a person from sleep. Additionally, this supplementary waking instrument could also work in combination with rousing instrument 70 at waking time 30.

Thus, in continuing reference to FIG. 1*a* and FIG. 1*b*, a user is able to wake comfortably, easily, and refreshed via alarm device 50. In use, a user sets a desired waking time 30. Inputted waking time 30 is then preferably used to determine ideal rousing time 20 based on predetermined time 21. However, in accordance with various alternate embodiments, a user may set both waking time 30 and rousing time 20. Additionally, a user may set rousing time 20 and waking time 30 may be determined based on this inputted time and predetermined time 21.

After setting waking time 30, a user sleeps normally. At rousing time 20, rousing instrument 70 activates and rouses the user from deep sleep. Preferably, the user is not woken fully and only comes out of deep sleep, resetting the sleep cycle. Then, after predetermined time 21, the user is woken fully at waking time 30. Thus, the user can be woken easily and comfortably during a preferable stage of their sleeping cycle (e.g. the end of the cycle) at waking time 30.

Figure 2:
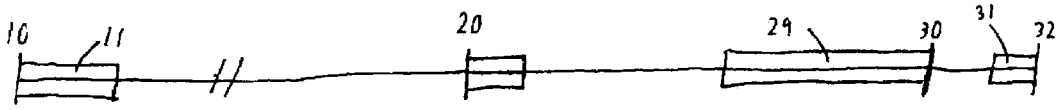
FIG. 2 is a diagram of an exemplary alarm device process comprising a sleep time, extended rousing time, a gradual waking time, and a snooze time.

Referring now to FIG. 2, in accordance with another alternate embodiment of the present invention, an alarm device process is shown further comprising a sleep time 11, a gradual pre-waking time 29, a gradual pre-snooze wake time 31, and a snooze wake time 32. Sleep time 11 allows a user to receive comforting stimuli (e.g. light, sound, etc.) for a predetermined time while falling to sleep. A prolonged rousing time 20 may comprise ascending and descending stimuli to better rouse a user. In accordance with another aspect of the present exemplary embodiment, gradual pre-waking time 29 preferably comprises gradually increasing stimuli (e.g. light, sounds, smells, etc.) to help wake a user from sleep. Similarly, gradual pre-snooze wake time 31 may comprise increasing stimuli to help wake a user from sleep before snooze wake time 32.

Additionally, in accordance with an alternate embodiment of the present invention, predetermined time 21, gradual rousing time 20, gradual pre-waking time 29, and rousing instrument 70 may be set and activated based on the output from an internal or external sleep diagnostic test. For example, a user may take a short test inputting their typical sleeping time, sleep depth (e.g. deep sleeper, light sleeper, etc.), waking exhaustion level, etc. This information may then be used to develop a customized waking program with tailored predetermined time 21 and rousing instrument 70 (e.g. sound, lights, stronger sound with lights, etc.). Similarly, other alarm processes and alarm device 50 features and settings may also be tailored based on such input or user preferences. Additionally, alarm device 50 may also track a user's sleeping exhaustion by having the user rate their morning exhausting level and adjusting the predetermined time 21, rousing instrument 70, and other alarm processes and features accordingly.

In accordance with an alternate embodiment of the present invention, a user may input when they are going to sleep at sleep time 10 (e.g. via a "sleep start" button) so that a more precise sleeping cycle length may be estimated (sleep cycles contract somewhat through the night). Additionally, this information may also be used to manage the user's sleep throughout the night by passively rousing the user at the appropriate sleep cycle times.

In accordance with another alternate embodiment of the present invention, alarm device 50 may comprise various settable usage functions. For example, alarm device 50 may be set to "nap" in which case rousing instrument 70 is deactivated. Alternatively, a user may set the alarm device to "night" and rousing instrument 70 would be activated. Additionally, alarm device 50 may be configured to comprise multiple alarm settings. For example, alarm device 50 may comprise a double alarm setting in which case a second waking time may be determined as well as a second, corresponding rousing time or an optimized single rousing time 20.

Figure 3A:
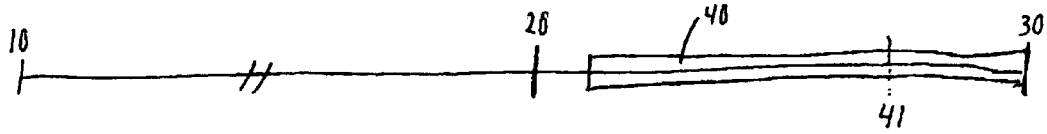
FIG. 3*a* is a diagram of an exemplary alarm device process comprising a rousing time, sensing time, and a waking time.
Figure 3B:
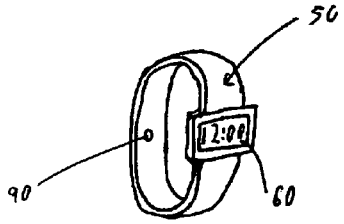
FIG. 3*b* is a perspective view of an exemplary embodiment of the present invention in the form of a watch device and comprising a sensing instrument; and, FIG. 4 is a diagram of an exemplary alarm device process comprising a waking time and a sensing time.

Now with reference to FIG. 3*a*, a diagram for a body sensing alarm device process is shown. In accordance with another aspect of the present exemplary embodiment, a sensing time 40 is further comprised. During sensing time 40, alarm device 50 tracks the user's sleep cycle stages via a sensor 90. Sensor 90 is suitably configured to sense a body variable such as a user's body temperature, movement, breathing rate, eye movement, and heart rate. Additionally, other body variables and combinations of body variables known and not yet known to the prior art may also be used. As shown in FIG. 3*b*, sensing alarm device 50 may be configured as a watch so that sensor 90 can easily track things like body temperature, movement, and heart rate while being worn by the user. However, in accordance with alternative embodiments, various other configurations may be used. For example, sensing alarm device 50 may be configured to be a bedside device with sensor 90 comprising an integrated motion detector (to detect body movement), a thermal sensor (e.g. infrared detector to detect body temperature), and a microphone (to sense heartbeat rate and/or breathing rate). Additionally, sensor 90 may comprise other sensing means known (e.g. fingertip heartbeat and body temperature sensor) and not yet known to the prior art.

In use, a user would set waking time 30 and alarm device 50 would rouse a user at rousing time 20. At rousing time 20 or a time between rousing time 20 and waking time 30, sensing time 40 would begin and sensor 90 would track body variables. During sensing time 40, alarm device 50 may then use these tracked body variables and wake the user when sensed to be an ideal waking time 41 based on the user's sleep cycle stage. If an ideal time 41 is not sensed, the user will be woken up no later than set waking time 30.

In accordance with various alternate embodiments of the present invention, alarm device 50 may further sense a user's sleep cycles throughout a sleeping period for data reporting and tracking purposes as well as better optimizing rousing time 20.

Figure 4:
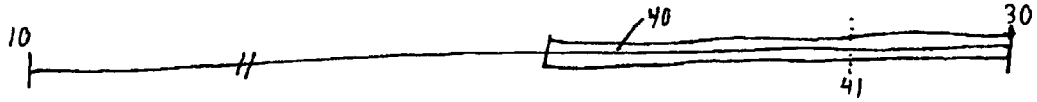

Now in reference to FIG. 4 and in accordance with an alternate embodiment of the present invention, sensing time 40 may also act as a desired waking time range. In accordance with one aspect of this exemplary embodiment, no rousing instrument 70 is comprised and alarm device 50 may determine the ideal waking time 41 within sensing time 40 based on body variables. Alternatively, sensing time 40 may last the entire sleeping period and a user may input a separate desired waking time range by setting waking time 30 and predetermined time 21 (predetermined time 21 may also be preset for the device), a start time and waking time 30, or a start time and predetermined time 21. If no ideal waking time 41 is determined within the inputted range, the user will be woken up no later than set walking time 30 (the latest time in the inputted range).

Thus, while the principles of the invention have been described in illustrative embodiments, many combinations and modifications of the above-described structures, arrangements, proportions, the elements, materials, and components, used in the practice of the invention in addition to those not specifically described may be varied and particularly adapted for a specific environment and operating requirement without departing from those principles.

I claim:

1. An alarm device comprising a time device and a rousing instrument configured to accept a desired waking time from a user, wherein said rousing instrument is configured to automatically activate at a rousing time occurring a predetermined time before said waking time and wherein said predetermined time is configured to be suitably aligned with a full sleep cycle and wherein said rousing instrument is further configured to deactivate after said rousing time and to remain deactivated until a time proximate said waking time.

2. The alarm device of claim 1, wherein said rousing instrument is configured to subsequently activate at said desired waking time to wake said user.

3. The alarm device of claim 1, wherein said rousing instrument is further configured to passively activate and deactivate during said rousing time.

4. The alarm device of claim 3, wherein said rousing time is configured to end at least 30 minutes before said waking time but not more than 120 minutes before said waking time.

5. The alarm device of claim 1, wherein said rousing instrument is further configured to require active deactivation by said user during said rousing time.

6. The alarm device of claim 5, wherein said rousing time is configured to end at least 30 minutes before said waking time but not more than 120 minutes before said waking time.

7. The alarm device of claim 1, wherein said rousing time is configured to end at least 30 minutes before said waking time but not more than 120 minutes before said waking time.

8. The alarm device of claim 7, wherein said predetermined time is configured to be adjustable based on input by said user.

9. The alarm device of claim 1, wherein said predetermined time is configured to be adjustable based on input by said user.

10. The alarm device of claim 9, wherein said adjustable predetermined time is configured to be determined by a sleeping diagnostic test.

11. The alarm device of claim 10, wherein said diagnostic test is integrated with said alarm device.

12. The alarm device of claim 11, wherein said test is further configured to track the waking exhaustion level of said user.

13. The alarm device of claim 1, wherein said rousing instrument further comprises adjustable intensity levels.

14. The alarm device of claim 1 wherein said alarm device is integrated with another device.

15. The alarm device of claim 12, wherein said rousing instrument comprises adjustable intensity levels and said intensity levels are determined by said test.

16. The alarm device of claim 1, wherein said rousing instrument is configured to be able to be deactivated before said rousing time.

17. The alarm device of claim 1, wherein said alarm device further comprises a sensor for sensing a desirable waking time after said rousing time and said waking time is adjusted based on input from said sensor.

* * * * *